US005266016A

United States Patent [19]

Kandpal

[11] Patent Number: 5,266,016

[45] Date of Patent: Nov. 30, 1993

[54] POSITIVE STOP FOR A SUCTION LEAF VALVE OF A COMPRESSOR

[75] Inventor: Tara C. Kandpal, Tecumseh, Mich.

[73] Assignee: Tecumseh Products Company, Tecumseh, Mich.

[21] Appl. No.: 408,763

[22] Filed: Sep. 18, 1989

[51] Int. Cl.[5] ..... F04B 27/08; F16K 15/16

[52] U.S. Cl. ..... 417/569; 417/571

[58] Field of Search ..... 417/569, 571

[56] References Cited

U.S. PATENT DOCUMENTS

| | | | |
|---|---|---|---|
| Re. 15,472 | 10/1922 | Riesner | 417/571 |
| 1,342,216 | 6/1920 | Henig | 137/516.11 |
| 2,243,123 | 5/1941 | Ritter | 417/571 |
| 2,338,544 | 1/1944 | Scattoloni | 417/569 |
| 2,908,287 | 10/1959 | Augustin | 137/525.3 |
| 3,998,571 | 12/1976 | Falke | 417/569 |
| 4,168,722 | 9/1979 | Mayer et al. | 137/516.11 |
| 4,257,458 | 3/1981 | Kondo et al. | 137/855 |
| 4,411,603 | 10/1983 | Kell | 417/479 |
| 4,470,774 | 9/1984 | Chambers | 417/567 |
| 4,537,566 | 8/1985 | Blass et al. | 417/569 |
| 4,642,037 | 2/1987 | Fritchman | 417/571 |
| 4,749,340 | 6/1988 | Ikeda et al. | 417/269 |

FOREIGN PATENT DOCUMENTS

| | | |
|---|---|---|
| 2642658 | 3/1977 | Fed. Rep. of Germany . |
| 2235296 | 1/1975 | France . |

OTHER PUBLICATIONS

French Search Report dated Mar. 10, 1993.

*Primary Examiner*—Richard A. Bertsch
*Attorney, Agent, or Firm*—Baker & Daniels

[57] ABSTRACT

A reciprocating piston hermetic compressor is disclosed, including a crankcase defining a cylinder, and a cylinder head and valve plate assembly attached to the top surface of the crankcase to cover the cylinder. A cantilevered suction leaf valve has an attached end intermediate the crankcase top surface and the valve plate. During a compression stroke of the compressor, the unattached end of the suction valve is forced by pressure against the valve plate to cover a suction inlet opening. During an intake stroke of the compressor, the unattached end is drawn away from the valve plate to open the suction inlet opening. The unattached end of the suction valve is limited in its travel into the cylinder by engagement with a positive stop defined by a generally inclined milled surface intersecting the crankcase top surface and the cylinder wall.

17 Claims, 3 Drawing Sheets

POSITIVE STOP FOR A SUCTION LEAF VALVE OF A COMPRESSOR

BACKGROUND OF THE INVENTION

The present invention relates generally to reciprocating piston compressors for compressing fluid and, more particularly, to such compressors having a cantilevered suction leaf valve, wherein a positive stop is provided in the top surface of the crankcase to limit the travel of the unattached end of the suction valve when the valve opens during an intake stroke of the compressor.

In a typical reciprocating piston compressor, a cylinder is defined by a compressor crankcase and a piston reciprocates within the cylinder to compress gaseous refrigerant therein. In a compressor to which the present invention pertains, a valve plate assembly is disposed intermediate the top surface of the crankcase and a cylinder head mounted thereto. The valve plate assembly includes a suction valve operable to permit fluid into the cylinder during an intake stroke of the compressor, and a discharge valve operable to exhaust fluid into a discharge space defined by the cylinder head during a compression stroke of the compressor.

With respect to the aforementioned valve plate assembly, a valve plate covers the cylinder and includes a suction inlet port extending therethrough to provide fluid communication between the cylinder and a suction pressure chamber in the cylinder head. A cantilevered suction leaf valve, also known as a "flapper" valve, is mounted adjacent the cylinder-facing side of the valve plate. An unattached end of the valve is in registry with the suction inlet port of the valve plate. During the compression stroke of the compressor, the unattached end is forced by pressure to sealingly cover the suction inlet port. During the intake stroke of the compressor, the unattached end is forced away from the valve plate by fluid being drawn through the suction inlet port.

In order to prevent overstressing and resulting fatigue of the suction leaf valve caused by bending during the intake stroke of the compressor, the unattached end of the valve is typically limited in its travel into the cylinder by engagement with a positive stop milled in the crankcase. For instance, the positive stop of the prior art comprises a flat-bottomed, crescent-shaped step that is end mill cut to a depth below the top surface of the crankcase and intersects the cylinder wall, as shown in FIG. 7.

While, the flat-bottomed positive stop of the prior art is generally effective in limiting the movement of the unattached end of the valve into the cylinder, several problems may be identified. For instance, the entire portion of the unattached end that contacts the flat bottom of the positive stop strikes the bottom surface simultaneously at high velocity. This results in excessive stress on the suction valve, which may reduce the life of the valve. Also, the impact of the contacting portion of the unattached end against the flat bottom of the positive stop may produce undesirable valve noise.

Reexpansion volume is a condition universally associated with and affecting the operating efficiency of reciprocating piston compressors, particularly smaller refrigeration type compressors. Generally, reexpansion volume is the volume remaining in the cylinder when the piston is at top dead center. Fluid occupying the reexpansion volume is compressed and expanded during each work cycle without producing an appreciable benefit. Accordingly, it is desired to minimize the reexpansion volume in a reciprocating piston compressor. To this end, specially designed pistons, valve plates, and valving have been developed to minimize reexpansion volumes.

The present invention is directed to overcoming the aforementioned problems associated with reciprocating piston compressors having cantilevered suction leaf valves and positive stops to limit the movement of the unattached ends thereof, wherein it is desired to reduce stresses on the suction valve and minimize reexpansion volumes in the cylinder.

SUMMARY OF THE INVENTION

The present invention overcomes the problems and disadvantages of the above-described prior art reciprocating piston compressors by providing an improved positive stop for limiting movement of the unattached end of a cantilevered suction leaf valve, wherein the shape of the positive stop results in both reduced valve stress and reduced reexpansion volume.

More specifically, the present invention provides a positive stop for a cantilevered suction leaf valve of a reciprocating piston compressor, wherein the unattached end of the suction valve is limited in its travel into the cylinder by engagement with a positive stop defined by a generally inclined milled surface intersecting the crankcase top surface and the cylinder wall.

An advantage of the reciprocating piston compressor of the present invention is that a positive stop for the unattached end of a cantilevered suction valve is provided which both reduces stresses on the valve and minimizes reexpansion volume in the cylinder.

Another advantage of the reciprocating piston compressor of the present invention, in accordance with one form thereof, is that the unattached end of a cantilevered suction valve is limited in its travel during the intake stroke of the compressor by a positive stop which forms a contacting interface with the unattached end, whereby the area of the interface increases in response to progressive opening movement of the valve, thereby reducing stresses on the valve and minimizing valve noise caused by impact of the valve with the positive stop.

A further advantage of the reciprocating piston compressor of the present invention is that a positive stop for limiting movement of the unattached end of a cantilevered suction valve when opening during the intake stroke of the compressor is provided which effectively reduces reexpansion volume in the cylinder over positive stops of the prior art, thereby improving the efficiency of the compressor.

The invention, in one form thereof, provides a reciprocating piston compressor assembly including a crankcase having a cylinder formed therein. The cylinder includes a side wall and an opening on a top surface of the crankcase. A valve plate is mounted to the top surface of the crankcase, thereby covering the cylinder opening. The valve plate includes a bottom surface adjacent the crankcase, and a suction inlet port extending through the valve plate and communicating with a valve seat on the bottom surface of the valve plate. A piston is disposed in the cylinder and is operably coupled to a drive mechanism which causes the piston to undergo reciprocating movement within the cylinder. Movement of the piston away from the valve plate constitutes an intake stroke, whereas movement of the piston toward the valve plate constitutes a compression stroke. A suction valve is generally adjacent the bottom surface of the valve plate, and includes an attached end and an unattached end. The unattached end is in registry with the valve seat and is movable during the intake stroke to an open position away from the bottom surface to uncover the valve seat. During the compression stroke, the unattached end is movable to a closed position to cover the valve seat. A positive stop is provided for limiting movement of the unattached end of the suction valve away from the valve plate during the intake stroke.

In accordance with one aspect of the invention, the positive stop is a generally planar surface formed in the crankcase against which the unattached end of the suction valve abuts. The stop surface is inclined with respect to the top surface of the crankcase, and intersects both the top surface of the crankcase and the cylinder side wall.

In accordance with another aspect of the invention, the abutment of the unattached end of the suction valve with the stop surface during the intake stroke results in a contacting interface therebetween. The area of the contacting interface increases progressively in response to movement of the unattached end in a direction away from the bottom surface of the valve plate.

DESCRIPTION OF THE PREFERRED EMBODIMENT

Figure 1:
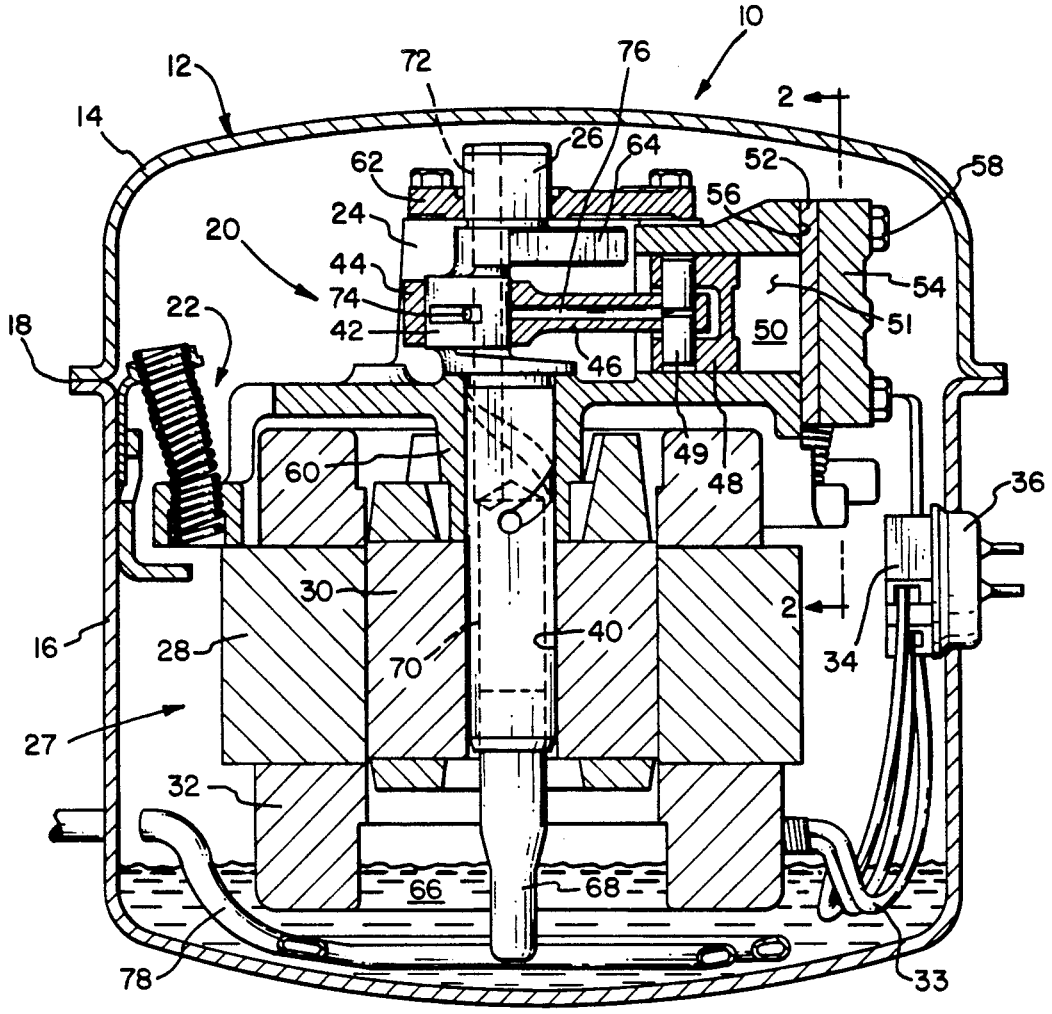
FIG. 1 is a longitudinal sectional view of a compressor of the type to which the present invention pertains.

Referring now to the drawings, and in particular to FIG. 1, there is shown a hermetic reciprocating piston compressor 10 of the type to which the present invention is applicable. Compressor 10 includes a housing 12 having an upper portion 14 and a lower portion 16, which are sealingly secured together at seam 18, as by welding. A motor-compressor unit 20 is resiliently mounted within housing 10 by means of a plurality of circumferentially spaced mounting assemblies 22.

Motor-compressor unit 20 includes a crankcase 24 having a crankshaft 26 rotatably received therein, and an electric motor 27 comprising a stator 28 and a rotor 30. Stator 28 is provided with windings 32, which are connected to an external current source by means of electrical leads 33, terminal block 34, and hermetic terminal 36. Rotor 30 has a central aperture 40 provide therein into which is secured crankshaft 26 by an interference fit.

Crankshaft 26 includes an eccentric portion 42, which is received in a closed loop end 44 of connecting rod 46. Connecting rod 46 is also connected to a piston 48 by means of a wrist pin 49. Crankcase 24 includes a cylinder bore 50, defined by cylinder side wall 51, in which piston 48 is reciprocatingly received. Cylinder 50 is covered by means of a valve plate 52 and a cylinder head 54, which are mounted to top surface 56 of crankcase 24 by means of a plurality of mounting bolts 58. Valve plate 52 and cylinder head 54 will be described in further detail in connection with a more detailed description of the present invention provided hereinafter.

Crankshaft 26 is rotatably journalled in a main bearing 60 and an outboard bearing 62 defined by respective bores formed in crankcase 24. A counterweight 64 is provided at the upper portion of crankshaft 26 to dynamically balance the rotating mass of eccentric portion 42 and closed loop end 44 of connecting rod 46.

Compressor 10 also has an oil lubrication system, including an oil sump 66 located generally in lower housing portion 16. A centrifugal oil pickup tube 68 is press fit into a bore 70 in the lower half of crankshaft 26, and is operable upon rotation of the crankshaft to pump oil upwardly through bore 70. An axial oil passage 72 intersects with bore 70 and extends along the upper half of crankshaft 26. A radial oil passage 72 is located in eccentric portion 42 and intersects with passage 72 to provide lubricating oil to closed loop end 44 of connecting rod 46. Connecting rod 46 also contains an oil passage 76 through which oil will travel from closed loop end 44 to lubricate wrist pin 49. An oil cooler tube 78 through which refrigerant flows is disposed within oil sump 66.

Figure 2:
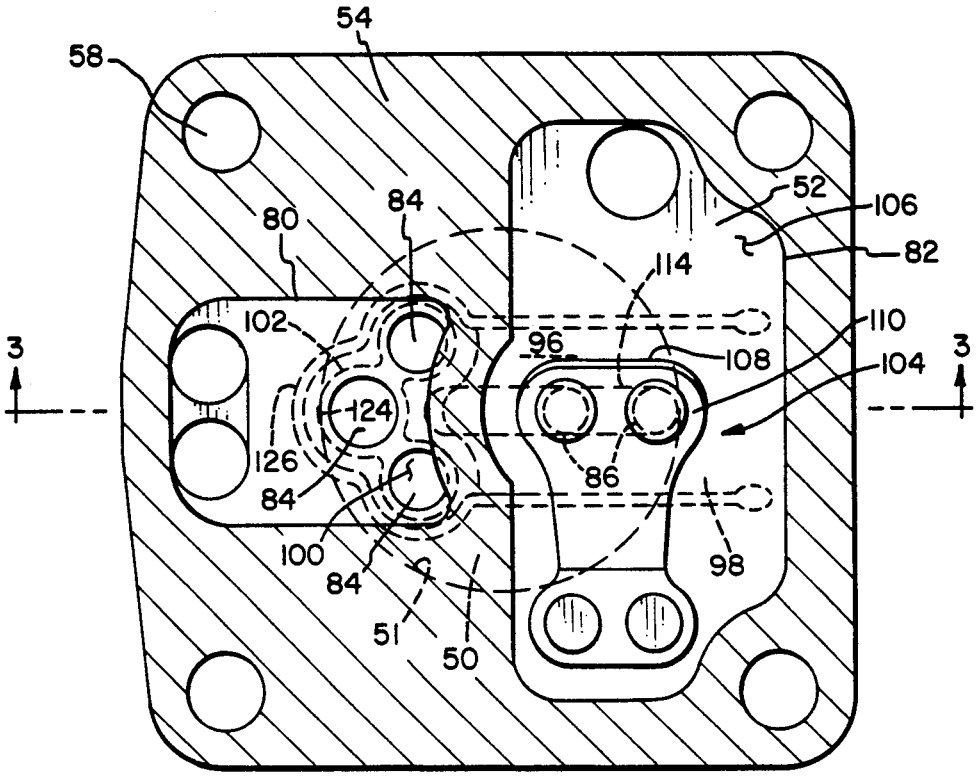
FIG. 2 is an enlarged sectional view of a portion of the compressor of FIG. 1, taken along the line 2—2 in FIG. 1 and viewed in the direction of the arrows, particularly showing a top plan view of the cylinder head and valve plate assembly portion of the compressor, in accordance with one embodiment of the present invention.
Figure 3:
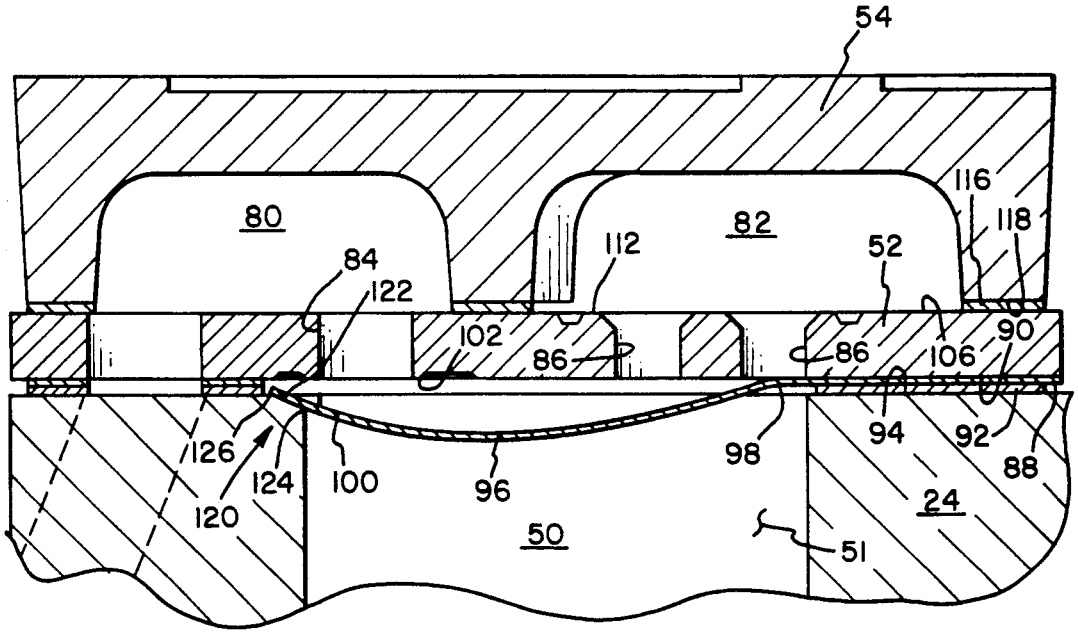
FIG. 3 is an enlarged fragmentary sectional view of the compressor of FIG. 1, taken along the line 3—3 in FIG. 2 and viewed in the direction of the arrows, particularly showing a side elevational view of the cylinder head and valve plate assembly of FIG. 2 operably positioned on the crankcase in registry with the cylinder.

Referring now to FIGS. 2 and 3 for a description of one embodiment of the present invention, cylinder head 54 includes a suction pressure chamber 80 and a discharge pressure chamber 82. Suction pressure chamber 80 is in fluid communication with cylinder 50 via a suction inlet opening comprising three suction inlet ports 84 extending through valve plate 52. Likewise, a discharge outlet opening comprising a pair of discharge outlet ports 86 extends through valve plate 52 to provide fluid communication between cylinder 50 and discharge pressure chamber 82.

In accordance with the embodiment of FIGS. 2 and 3, a planar valve sheet 88 is disposed adjacent a bottom surface 90 of valve plate 52, and a gasket 92 is disposed intermediate valve sheet 88 and a top surface 94 of crankcase 24. Valve sheet 88 is die stamp cut to form a cantilevered suction leaf valve 96 having an attached end 98 integral with the valve sheet, and an unattached end 100 in registry with suction inlet ports 84 and capable of moving out of the plane of the valve sheet. During a compression stroke of the compressor, unattached end 100 is forced by pressure developed in cylinder 50 to cover suction inlet ports 84. Specifically, unattached end 100 seats on a valve seat 102 surrounding suction inlet ports 84. Valve sheet 88 of the preferred embodiment preferably comprises 0.012 inch thick Swedish flapper valve steel.

A conventional discharge pressure valve assembly 104 is operably mounted on a top surface 106 of valve plate 52 in registry with discharge outlet ports 86, as shown in FIG. 2. Valve assembly 104 comprises a discharge flapper valve 108 and an overlapping valve retainer 110. Upon closing during an intake stroke of the compressor, valve 108 seats on a valve seat 112 surrounding discharge outlet ports 86. It will be noted that suction leaf valve 96 includes an elongate aperture 114 to facilitate fluid communication between discharge outlet ports 86 and cylinder 50. According to one embodiment of the discharge valve assembly, valve 108 is made of 0.012 inch thick Swedish flapper valve steel, and valve retainer 110 is made of 0.065–0.070 inch thick S.A.E. #1010 hot or cold rolled steel. As shown in FIG. 3, a valve plate gasket 116 is provided between top surface 106 and a bottom surface 118 of cylinder head 54.

In accordance with the principles of the present invention, a positive stop 120 is provided in crankcase 24, against which unattached end 100 of suction leaf valve 96 abuts to limit the travel of valve 96 away from valve plate 52 during the intake stroke of the compressor. More specifically, with reference to FIG. 2, a generally planar inclined stop surface 122 is end mill cut into crankcase 24 such that surface 122 intersects cylinder side wall 51 along a line of intersection designated at 124 and intersects top surface 94 of crankcase 24 along a line of intersection designated at 126. An axial projection of lines 124 and 126 onto top surface 94 of crankcase 24 results in a crescent shape.

Figure 6:
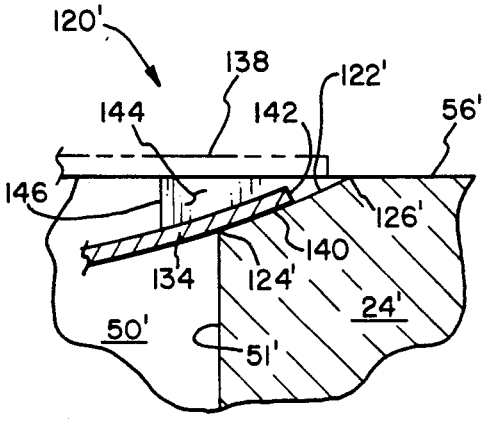
FIG. 6 is an enlarged fragmentary view of FIG. 5, particularly showing the positive stop and the unattached end of the suction leaf valve in both closed and open positions.
Figure 4:
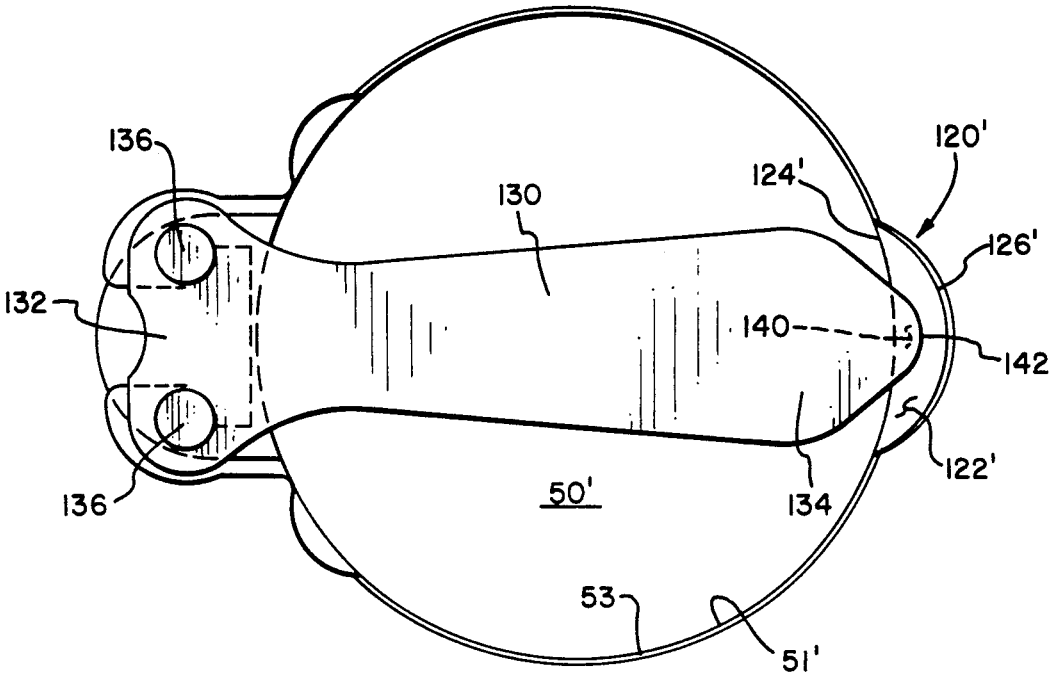
FIG. 4 is a top plan view of a cantilevered suction leaf valve that extends over a cylinder defined by a crankcase having a positive stop for the unattached end of the leaf valve, in accordance with another embodiment of the present invention.
Figure 5:
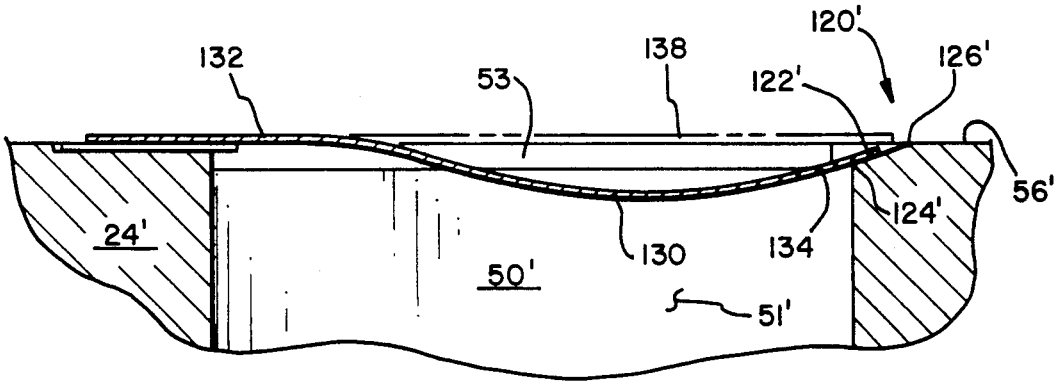
FIG. 5 is a fragmentary side elevational sectional view of the crankcase and suction leaf valve assembly of FIG. 4, taken along the line 5—5 in FIG. 4 and viewed in the direction of the arrows, particularly showing the suction leaf valve in an open position with its unattached end contacting the positive stop.

The present invention will now be further described in connection with an alternative embodiment as shown in FIGS. 4–6. The embodiment of FIGS. 4–6 relates to an alternative suction valve assembly for compressor 10 of FIG. 1. Accordingly, to the extent that components in FIGS. 4–6 relate to identical components in FIGS. 1–3, the foregoing description is equally applicable to the alternative embodiment wherein the reference numerals identifying such identical components will be primed. New reference numerals will be used to designate components changed in the alternative embodiment.

Referring now to FIGS. 4 and 5, there is shown an elongate reed-type suction valve 130, including an attached end 132 and an unattached end 134. As illustrated, the length of suction valve 130 is greater than the diameter of cylinder 50', whereby respective distal portions of attached end 132 and unattached end 134 extend beyond the perimeter of the cylinder opening. Cylinder side wall 51' includes a chamfer 53 adjacent top surface 56' of crankcase 24'.

Attached end 132 of cantilevered valve 130 is retained and indexed intermediate the valve plate and top surface of the crankcase, as previously described, by means of pair of indexing apertures 136 through which extend a corresponding pair of locating pins, rivets, screws, or the like (not shown). For instance, a pair of locating pins received through apertures 136 could extend between respective locating holes in the valve plate and crankcase.

Unattached end 134 of suction valve 130 is movable during intake and compression strokes of the compressor to open and close a suction inlet opening in a valve plate covering cylinder 50', as previously described with respect to the embodiment of FIGS. 1–3. Specifically, FIG. 5 shows suction valve 130 in a fully opened position, while a fully closed position of suction valve 130 is illustrated by a phantom representation designated at 138. A positive stop 120' is provided in crankcase 24', against which unattached end 134 of suction valve 130 abuts to limit the travel thereof during opening of the valve.

Positive stop 120' will now be more particularly described with reference to FIGS. 5 and 6. Stop surface 122' of positive stop 120' is inclined with respect to top surface 56' of crankcase 24' and intersects top surface 56' at a line of intersection designated at 126'. Inclined stop surface 122' also intersects cylinder side wall 51' at a line of intersection designated at 124', whereby the axial projection of the stop surface onto the plane of the crankcase top surface is a crescent shape bounded by lines 124' and 126', as can be seen in FIG. 4.

In accordance with the principles of the present invention, and referring to the embodiment of FIGS. 4–6, stop surface 122' and unattached end 134 of suction valve 130 establish a contacting interface 140 therebetween, which progressively increases in area in response to progressive opening movement of unattached end 134 away from the valve plate and against stop surface 122'. Referring to FIG. 6, an extreme distal end 142 of unattached end 134 is spaced from stop surface 122' when suction valve 130 is in its full open position at 138. As illustrated, distal end 142 extends radially beyond the perimeter of cylinder 50', but does not extend beyond the line of intersection 126.

At the beginning of an intake stroke, unattached end 134 of suction valve 130 begins its downward opening movement. Distal end 142 is the first part of the valve to contact stop surface 122' and establish contacting interface 140, after which continued downward movement of unattached end 134 toward the full open position progressively increases the area of contacting interface 140. It is this progressive contact of unattached end 134 with stop surface 122', rather that simultaneous contact of the entire contacting interface, that results in reduced stresses on the suction valve and decreased valve noise.

In a preferred method of forming a positive stop in a compressor crankcase, in accordance with the present invention, an end mill cut is made with a milling tool positioned to overlap the cylinder and a crescent-shaped portion of the adjacent top surface of the crankcase. The longitudinal axis about which the milling tool rotates is inclined with respect to the cylinder axis to form a stop surface similarly inclined with respect to the top surface of the crankcase. The resulting positive stop, with reference to FIG. 6, includes a generally planar stop surface 122' and opposing walls 144 which intersect cylinder side wall 50' at 146 and converge toward top surface 56' of crankcase 24'. Depending upon the shape of the end of the milling tool, stop surface 122' may be shaped slightly concave.

Figure 7:
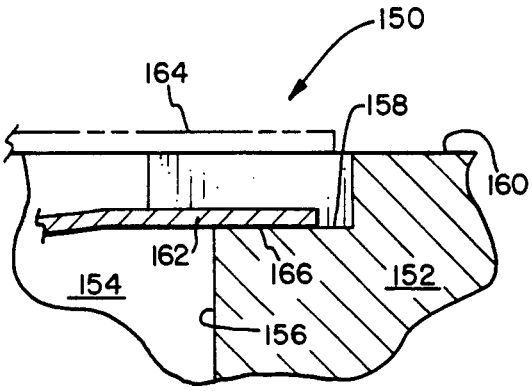
PRIOR ART FIG. 7
FIG. 7 is a view similar to that of FIG. 6, illustrating a prior art flat-bottomed positive stop for the unattached end of a suction leaf valve.

FIG. 7, already referred to in the discussion relating to the prior art, shows a prior art positive stop 150 formed in a crankcase 152 having a cylinder 154 and cylinder side wall 156. Positive stop 150 includes a flat-bottomed mill cut intersecting cylinder 154. Specifically, a stop surface 158 is parallel to planar top surface 160 of crankcase 152. As previously noted, when an unattached end 162 of the suction valve moves from a fully closed position at 164 to a fully open position, as shown, a contacting interface 166 between unattached end 162 and stop surface 158 is simultaneously established, thereby resulting in stresses on the valve and valve noise.

A primary advantage of a positive stop in accordance with the present invention over prior art positive stops is the reduction of reexpansion volume in the cylinder. This is clearly illustrated by comparing the positive stop configuration of FIG. 6, i.e., according to the present invention, with the prior art positive stop of FIG. 7. By inclining the stop surface between the points of intersection with the cylinder side wall and crankcase top surface, the reexpansion volume attributable to the positive stop is reduced considerably.

It will be appreciated that the foregoing description of several embodiments of the invention is presented by way of illustration only and not by way of any limitation, and that various alternatives and modifications may be made to the illustrated embodiments without departing from the spirit and scope of the invention.

What is claimed is:

1. A reciprocating piston compressor assembly, comprising:

a crankcase including a cylinder having a cylinder side wall and a cylinder opening on a top surface of said crankcase;

a valve plate mounted to said top surface of said crankcase and covering said cylinder opening, said valve plate including a bottom surface adjacent said crankcase and a suction inlet port extending through said valve plate and communicating with a valve seat on said bottom surface of said valve plate;

a piston reciprocatingly disposed in said cylinder;

drive means for causing said piston to undergo reciprocating movement within said cylinder, wherein movement of said piston away from said valve plate constitutes an intake stroke and movement of said piston toward said valve plate constitutes a compression stroke;

a suction valve generally adjacent said bottom surface of said valve plate and having an attached end and an unattached end, said unattached end of said suction valve being in registry with said valve seat and being movable during said intake stroke to an open position away from said bottom surface to uncover said valve seat, and being movable during said compression stroke to a closed position against said bottom surface to cover said valve seat; and positive stop means for limiting said movement of said unattached end of said suction valve away from said bottom surface during said intake stroke, said positive stop means comprising a generally planar stop surface formed in said crankcase against which said unattached end of said suction valve abuts, said stop surface being inclined with respect to said top surface of said crankcase and intersecting said top surface and said cylinder side wall.

2. The compressor assembly of claim 1 in which:

said suction valve is elongate and has a longitudinal dimension greater than the diameter of said cylinder opening, and said suction valve traverses said cylinder opening such that said attached end and said unattached end each extend beyond the perimeter of said cylinder opening.

3. The compressor assembly of claim 2 in which:

said unattached end of said suction valve extends radially beyond the perimeter of said cylinder opening a distance no greater than the radial distance at which said stop surface intersects with said top surface of said crankcase.

4. The compressor assembly of claim 1 in which:

said unattached end of said suction valve is spaced from said stop surface during said compression stroke.

5. The compressor assembly of claim 1 in which:

the abutment of said unattached end of said suction valve with said stop surface during said intake stroke results in a contacting interface therebetween, and said unattached end of said suction valve includes an extreme distal end which is in contact with said stop surface at a radially outermost point of said contacting interface with respect to said cylinder opening.

6. The compressor assembly of claim 5 in which:

said extreme distal end of said unattached end of said suction valve is the first point of contact between said unattached end and said stop surface during said intake stroke, after which said contacting interface moves radially inwardly in response to said movement of said unattached end away from said bottom surface of said valve plate.

7. The compressor assembly of claim 1 in which:

the abutment of said unattached end of said suction valve with said stop surface during said intake stroke results in a contacting interface therebetween, the area of said contacting interface increasing progressively in response to movement of said unattached end away from said bottom surface of said valve plate.

8. The compressor assembly of claim 1 in which:

said stop surface is slightly concave upwardly generally toward said top surface of said crankcase.

9. The compressor assembly of claim 1 in which:

said suction valve comprises a planar valve sheet disposed intermediate said bottom surface of said valve plate and said top surface of said crankcase, said valve sheet including a cantilevered elongate valve portion, wherein said attached end is integral with said valve sheet and said unattached end is free to move out of the plane of said valve sheet.

10. The compressor assembly of claim 9, and further comprising:

a planar gasket disposed intermediate said valve sheet and said top surface of said crankcase.

11. The compressor assembly of claim 1 in which:

said suction valve comprises an elongate reed valve, wherein said attached end includes at least one aperture for mounting and properly indexing said suction valve.

12. The compressor assembly of claim 1 in which:

the axial projection of said stop surface onto said top surface of said crankcase is a crescent shape, bounded by said cylinder opening and said intersection of said stop surface with said top surface of said crankcase.

13. A reciprocating piston compressor assembly, comprising:

a crankcase including a cylinder having a cylinder side wall and a cylinder opening on a top surface of said crankcase;

a valve plate mounted to said top surface of said crankcase and covering said cylinder opening, said valve plate including a bottom surface adjacent said crankcase and a suction inlet port extending through said valve plate and communicating with a valve seat on said bottom surface of said valve plate;

a piston reciprocatingly disposed in said cylinder;

drive means for causing said piston to undergo reciprocating movement within said cylinder, wherein movement of said piston away from said valve plate constitutes an intake stroke and movement of said piston toward said valve plate constitutes a compression stroke;

a suction valve generally adjacent said bottom surface of said valve plate and having an attached end and an unattached end, said unattached end of said suction valve being in registry with said valve seat and being movable during said intake stroke to an open position away from said bottom surface to uncover said valve seat, and being movable during said compression stroke to a closed position against said bottom surface to cover said valve seat; and positive stop means formed in said crankcase for progressively contacting said unattached end of said suction valve as said unattached end moves away from said bottom surface of said valve plate during said intake stroke, said positive stop means comprising a generally planar stop surface that is inclined with respect to said top surface of said crankcase and intersects both said top surface of said crankcase and said cylinder side wall.

14. The compressor assembly of claim 13 in which:

said unattached end of said suction valve contacts said top surface during said intake stroke to establish a contacting interface therebetween, the area of said contacting interface increasing progressively in response to movement of said unattached end away from said bottom surface of said valve plate.

15. The compressor assembly of claim 14 in which:

said suction valve is elongate and has a longitudinal dimension greater than the diameter of said cylinder opening, and said suction valve traverses said cylinder opening such that said attached end and said unattached end each extend beyond the perimeter of said cylinder opening, said unattached end extending radially beyond the perimeter of said cylinder opening a distance no greater than the radial distance at which said stop surface intersects with said top surface of said crankcase.

16. The compressor assembly of claim 13 in which:

said unattached end of said suction valve is spaced from said stop surface during said compression stroke.

17. The compressor assembly of claim 13 in which:

said suction valve comprises a planar valve sheet disposed intermediate said bottom surface of said valve plate and said top surface of said crankcase, said valve sheet including a cantilevered elongate valve portion, wherein said attached end is integral with said valve sheet and said unattached end is free to move out of the plane of said valve sheet.

* * * * *